US005618457A

United States Patent [19]

Wilkinson

[11] Patent Number: 5,618,457

[45] Date of Patent: Apr. 8, 1997

[54] METHOD OF APPLYING A SCENT TO HAIR ROLLERS

[76] Inventor: William T. Wilkinson, P.O. Box 73, Salem, N.J. 08079

[21] Appl. No.: 337,892

[22] Filed: Nov. 14, 1994

[51] Int. Cl.[6] ..... A45D 4/10

[52] U.S. Cl. ..... 219/222; 219/521; 219/687; 392/387; 132/200; 132/228; 132/272

[58] Field of Search ..... 219/222, 521, 219/682; 392/387, 386, 403, 404, 391; 132/200, 228, 227, 272, 229; 422/298, 299; 34/439, 440

[56] References Cited

U.S. PATENT DOCUMENTS

| | | | |
|---|---|---|---|
| 1,944,821 | 1/1934 | Blaise | 392/403 |
| 3,493,722 | 2/1970 | Popeil | 219/222 |
| 3,700,853 | 10/1972 | Jensen et al. | 219/222 |
| 3,749,106 | 7/1973 | Kelmann et al. | 132/200 |
| 3,754,116 | 8/1973 | Godel | 219/222 |
| 3,858,029 | 12/1974 | Walter | 219/222 |
| 4,516,011 | 5/1985 | Jeffress et al. | 219/222 |
| 5,286,949 | 2/1994 | Simons | 132/200 |

FOREIGN PATENT DOCUMENTS

| | | |
|---|---|---|
| 60-78905 | 5/1985 | Japan . |

*Primary Examiner*—John A. Jeffery
*Attorney, Agent, or Firm*—Connolly & Hutz

[57] ABSTRACT

Hair rollers are heated and moistened by being exposed to steam. The invention involves incorporating a scent creating substance such as perfume in the liquid which is heated to create the steam so that the steam incorporates a scent which is thereby applied to the rollers.

5 Claims, 2 Drawing Sheets

METHOD OF APPLYING A SCENT TO HAIR ROLLERS

BACKGROUND OF THE INVENTION

Various devices and techniques exist for heating and moistening hair rollers or hair curlets. An exemplary device is disclosed in U.S. Pat. No. 5,286,949 wherein the hair rollers are mounted so as to be exposed to a chamber. Steam is then created from a liquid to flow into the chamber and contact the hair roller. In this manner the rollers are both heated and moistened from the steam. Thereafter the rollers are removed and applied to the hair.

Since the rollers are in intimate contact on the user's head in close proximity to the nose, it would be disadvantageous if the rollers had an unpleasant aroma.

SUMMARY OF THE INVENTION

This object of this invention is to provide an advance in the conventional techniques for heating and moistening hair rollers by applying a scent to the rollers.

A further object of this invention is to provide a method of applying a scent to the rollers which could easily be adapted to virtually all existing techniques and devices which heat and moisten rollers.

In accordance with this invention the liquid, such as water used for creating steam, has a scent creating substance added to the liquid. In this manner, when the liquid is heated and the steam is created a scent is incorporated in the resulting steam. Consequently, the rollers are contacted by the scent so that the scent is correspondingly applied to the rollers and thereby creates a pleasant aroma for the user.

DETAILED DESCRIPTION

Figure 2:
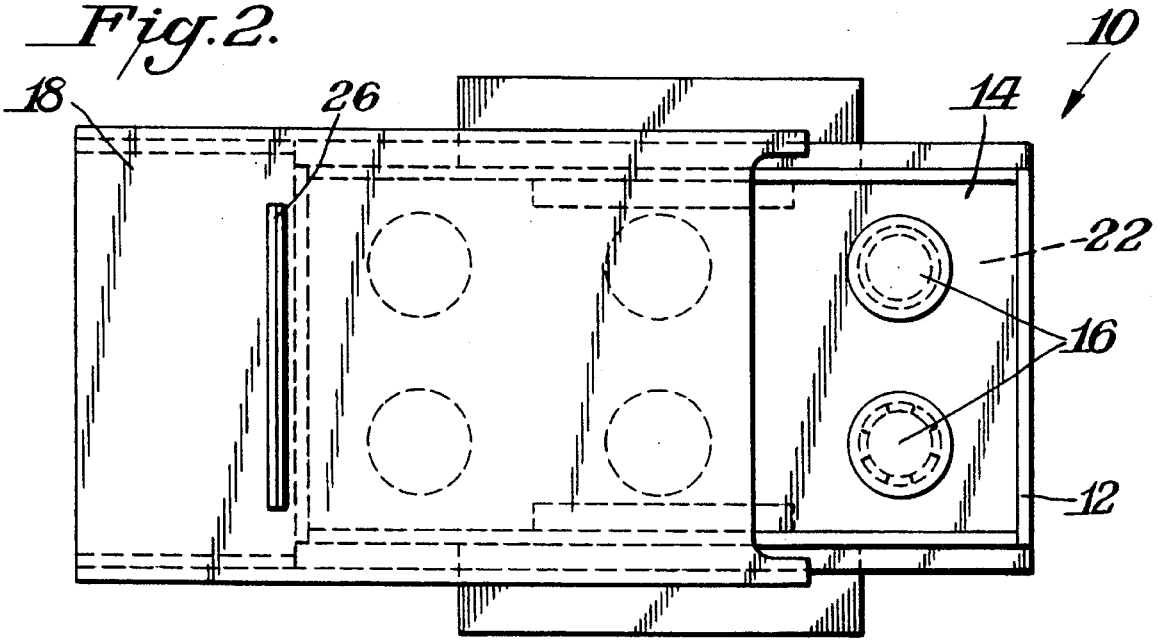
FIG. 2 is a top plan view of the device of FIG. 1.
Figure 1:
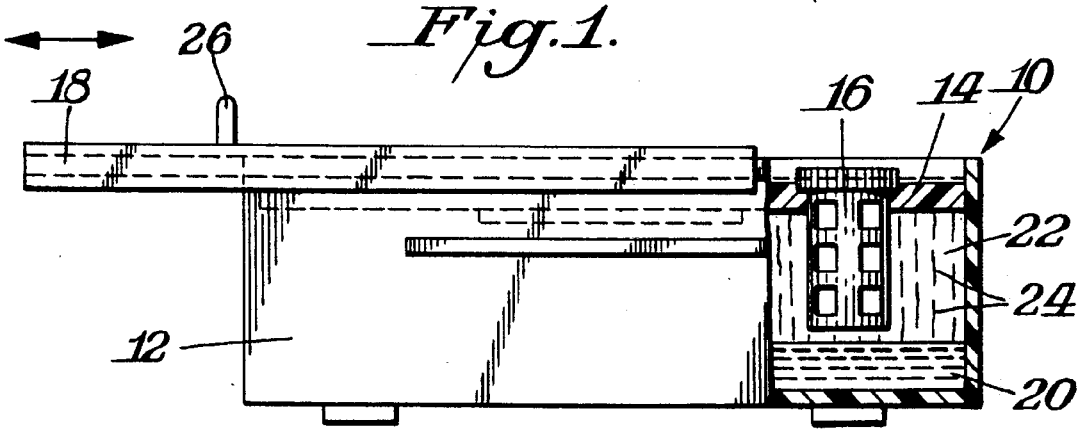
FIG. 1 illustrates a side elevational view partially broken away of a hair roller heating and moistening device which may incorporate the techniques of this invention.

The Figure illustrates an exemplary device for heating and moistening hair rollers by creating steam. The device illustrated in the Figure is based upon the device shown and described in U.S. Pat. No. 5,286,949, the details of which are incorporated herein by reference thereto.

As illustrated the device 10 includes a container 12 with a support 14 having a plurality of openings for receiving individual hair cutlers 16. A slidable lid 18 is mounted at the top of container 12 for selectively providing access to the hair curlers and for closing the top of container 12. A fluid such as water 20 is placed in the bottom of container 12 and when heated, such as by placing the device 10 in a microwave oven, the fluid creates steam 24 in the chamber 22 in which the suspended rollers 16 are mounted. As a result, the rollers 16 are both moistened and heated, Handle 26 is then manipulated by being pushed to the left to remove lid 18 and permit the rollers 16 to then be taken from support 14 and placed in the user's hair.

The present invention involves the incorporation of a scent creating substance into the liquid 20. Any suitable scent creating substance :may be used, such as perfume, cologne or substances which create incense. In the preferred practice of the invention a liquid perfume is mixed with the water.

Figure 3:
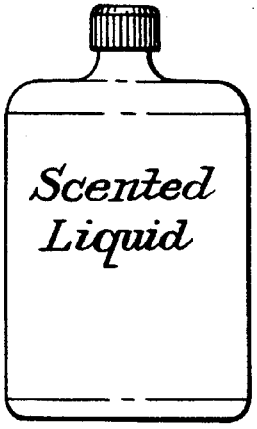
FIG. 3 is a side elevational view of a pre-packaged scented liquid.

The scent creating substance may be added in any suitable manner. For example, fluid and substance may be prepackaged in a common container (as shown in FIG. 3) which would then be opened and the contents placed in the bottom of container 12. Alternatively, the fluid 20 may be tap water or distilled water and the scent creating substance may be added to the water either before or after the water is placed in container 12. For example, the scent creating substance could be itself prepackaged in packets wherein, for example, each packet is intended to be used with a predetermined measured amount of water suitable for a single use of device 10.

Figure 4:
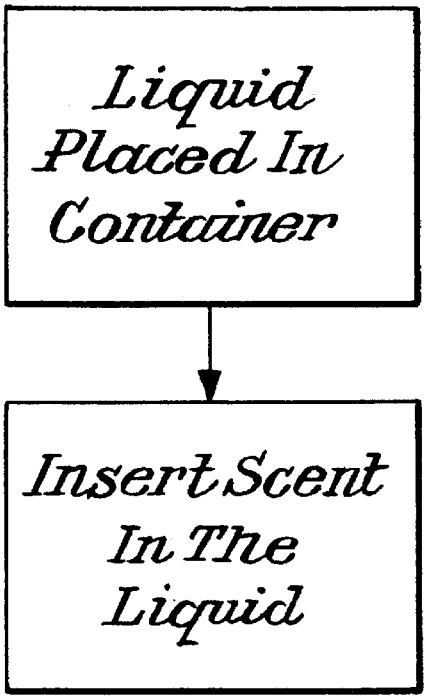
FIGS. 4–5 are block diagrams showing method steps in the practice of this invention.
Figure 5:
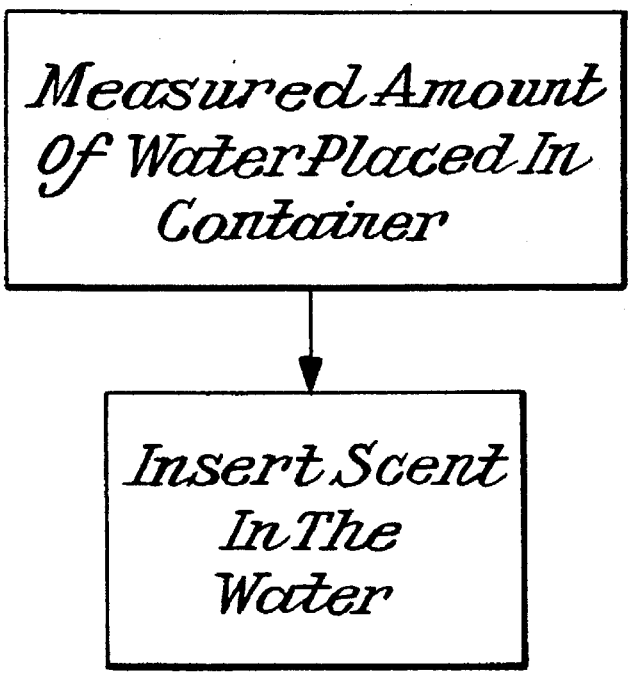

By incorporating the scent creating substance in the liquid 20, the resultant steam becomes scented to thereby apply a corresponding scent to the rollers. FIGS. 4–5 show in block diagram the method steps for alternate methods of practicing the invention.

It is to be understood that any suitable scent creating substance may be utilized in the practice of this invention. The particular substance would be selected in accordance with the desired strength and aroma of the substance. Such terms as perfume and cologne are art accepted terms which are known and used in the art to connote different strengths with, for example, perfume being of a higher strength scent than cologne. Perfume would be the preferred scent applying substance since it would apply a stronger scent.

What is claimed is:

1. In a method of heating and moistening hair rollers wherein the rollers are mounted in a chamber where the rollers are exposed to steam in the chamber with the steam being created by heating a liquid, the improvement being in that a scent creating substance is added to the liquid before the liquid is heated to incorporate the scent creating substance in the resulting steam, and the scent creating substance applying a corresponding scent to the rollers.

2. The method of claim 1 wherein the liquid and the scent creating substance are pre-packaged together and jointly placed in a container in the device for applying steam to the rollers.

3. The method of claim 1 wherein the liquid is placed in a container in the device for applying steam to the rollers, and the scent creating substance is inserted into the liquid after the liquid is in the container.

4. The method of claim 1 wherein the liquid is water, a measured amount of the water being placed in a container, and thereafter inserting the scent creating substance in the water.

5. The method of claim 1 wherein the scent creating substance is perfume.

* * * * *